US009166377B2

(12) United States Patent
Aochi et al.

(10) Patent No.: US 9,166,377 B2
(45) Date of Patent: Oct. 20, 2015

(54) SPARK PLUG FOR INTERNAL COMBUSTION ENGINE

(71) Applicant: DENSO CORPORATION, Kariya, Aichi-pref. (JP)

(72) Inventors: Takanobu Aochi, Nishio (JP); Masamichi Shibata, Toyota (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 13/743,753

(22) Filed: Jan. 17, 2013

(65) Prior Publication Data

US 2013/0214668 A1 Aug. 22, 2013

(30) Foreign Application Priority Data

Feb. 17, 2012 (JP) ..... 2012-033171

(51) Int. Cl.
*H01T 13/20* (2006.01)
*H01T 13/32* (2006.01)

(52) U.S. Cl.
CPC ..... *H01T 13/20* (2013.01); *H01T 13/32* (2013.01)

(58) Field of Classification Search
CPC ..... H01T 21/02; H01T 13/32; H01T 13/20; H01T 13/54; H01T 13/34; H01T 21/06; H01T 13/02; H01T 13/00; F23Q 3/006; F23Q 7/22
USPC ..... 313/118–145; 123/169 R, 169 EL, 32, 123/41, 310; 445/7
See application file for complete search history.

(56) References Cited

U.S. PATENT DOCUMENTS

| | | | | |
|---|---|---|---|---|
| 2008/0164800 | A1* | 7/2008 | Watanabe | 313/141 |
| 2010/0320894 | A1* | 12/2010 | Hartmann et al. | 313/142 |
| 2011/0215702 | A1* | 9/2011 | Kameda et al. | 313/141 |
| 2013/0076224 | A1* | 3/2013 | Keller et al. | 313/141 |

FOREIGN PATENT DOCUMENTS

| | | |
|---|---|---|
| JP | 05-315049 | 11/1993 |

* cited by examiner

*Primary Examiner* — Anh Mai
*Assistant Examiner* — Fatima Farokhrooz
(74) *Attorney, Agent, or Firm* — Nixon & Vanderhye P.C.

(57) ABSTRACT

The spark plug for an internal combustion engine has a cylindrical housing, a center electrode held inside the housing, a ground electrode connected to the housing and forming a spark discharge gap between itself and the center electrode, and, an end projection projected from the end portion of the housing toward the head end side of the spark plug. The center electrode and ground electrode are arranged so that most of the spark discharge gap is disposed over the open areas and the electrode area in which the end projection is arranged.

9 Claims, 12 Drawing Sheets

SPARK PLUG FOR INTERNAL COMBUSTION ENGINE

CROSS-REFERENCE TO RELATED APPLICATION

This application is based on and claims the benefit of priority from earlier Japanese Patent Application No. 2012-033171 filed Feb. 17, 2012, the description of which is incorporated herein by reference.

BACKGROUND OF THE INVENTION

1. Technical Field of the Invention

The present invention relates to a spark plug for an internal combustion engine, which is used such as for an automotive engine.

2. Related Art

A spark plug is used as an igniting means in an internal combustion engine, such as an automotive engine. For example, in such a spark plug, a center electrode and a ground electrode are arranged opposed to each other in the axial direction of the spark plug to form a spark discharge gap therebetween. In such a spark plug, discharge is permitted to occur in the spark discharge gap so that the discharge can ignite air-fuel mixture in the combustion chamber.

In the combustion chamber, a flow of air-fuel mixture, such as a swirl flow or a tumble flow is formed. The flow is also moderately led to the spark discharge gap to ensure ignitability.

A spark plug is mounted in a posture to an internal combustion engine. Depending on the posture of the spark plug with respect to the internal combustion engine (hereinafter referred to as a "mounted posture"), a part of the ground electrode connected to an end portion of a housing may be located upstream of the spark discharge gap within the flow of air-fuel mixture. With this location, the flow of air-fuel mixture in the combustion chamber is blocked by the ground electrode and accordingly, the flow in the vicinity of the spark discharge gap is likely to stagnate.

As a result, ignitability of the spark plug may be deteriorated. Specifically, depending on the mounted posture of the spark plug with respect to the internal combustion engine, ignitability of the spark plug may be problematically varied. In recent years, in particular, there is a growing trend of using a lean-burn internal combustion engine. In such an internal combustion engine, combustion stability is likely to be deteriorated depending on the mounted posture of the spark plug.

In addition, it is difficult to control the mounted posture of the spark plug with respect to the internal combustion engine, i.e. to control the location of the ground electrode in the circumferential direction of the spark plug (i.e. mounting angle). The mounted posture is varied depending such as on the mounting state (for example, mounting angle) of the screws used for mounting the spark plug in a housing, or the degree of tightening the screws in the work of mounting the spark plug to the internal combustion engine.

A patent document JP-A-H05-315049 discloses a spark plug in which a spark discharge gap is formed being distanced from the body of the spark plug as much as possible, so that the spark discharge gap is exposed to a larger amount of air-fuel mixture and that fresh air-fuel mixture can easily flow into the spark discharge gap.

However, it is also difficult for the spark plug disclosed in JP-A-H05-315049 to avoid the problem set forth above. That is, the problem that ignitability of the spark plug is varied depending on the mounted posture of the spark plug with respect to the internal combustion engine, i.e. the location of the ground electrode in the circumferential direction of the spark plug. In the configuration disclosed in JP-A-H05-315049 as well, the ground electrode or the center electrode is located upstream of the spark discharge gap, depending on the mounted posture of the spark plug, causing the flow of air-fuel mixture to stagnate in the spark discharge gap. In this way, ignitability of the spark plug is likely to be varied depending on the mounted posture of the spark plug.

SUMMARY

The present invention has been made in light of the background as set forth above and has as its object to provide a spark plug for an internal combustion engine, which is able to ensure stable ignitability irrespective of the mounted posture of the spark plug with respect to an internal combustion engine.

An exemplary embodiment provides a spark plug for an internal combustion engine which has a cylindrical housing, a center electrode held inside the housing, a ground electrode connected to the housing and forming a spark discharge gap between itself and the center electrode, and, an end projection projected from the housing toward the head end side of the spark plug. The end projection is configured to guide the flow of the air fuel mixture to the spark discharge gap. The center electrode and ground electrode are arranged so that the spark discharge gap is disposed being away from stagnation of the flow of the air fuel mixture.

DETAILED DESCRIPTION OF THE PREFERRED EMBODIMENTS

With reference to the accompanying drawings, hereinafter are described several embodiments of a spark plug for an internal combustion engine of the present invention.

It should be appreciated that, throughout the specification, the side on which the spark plug is inserted into a combustion chamber is referred to as a "head end side" and the side opposite to the head end side is referred to as a "base end side".

Further, throughout the specification, the terms "axial", "axially" or "axial direction", the terms "radial", "radially" or "radial direction" and the terms "circumferential", "circumferentially" or "circumferential direction" refer to "the axial direction of the spark plug", "the radial direction of the spark plug" and the "circumferential direction of the spark plug", respectively. Furthermore, the term "plug center axis" refers to the center axis of the spark plug, i.e. the center axis of the housing, as viewed in the axial direction.

(First Embodiment)

Referring to FIGS. 1 to 4, hereinafter is described a spark plug 1 for an internal combustion engine, according to a first embodiment of the present invention.

Figure 1:
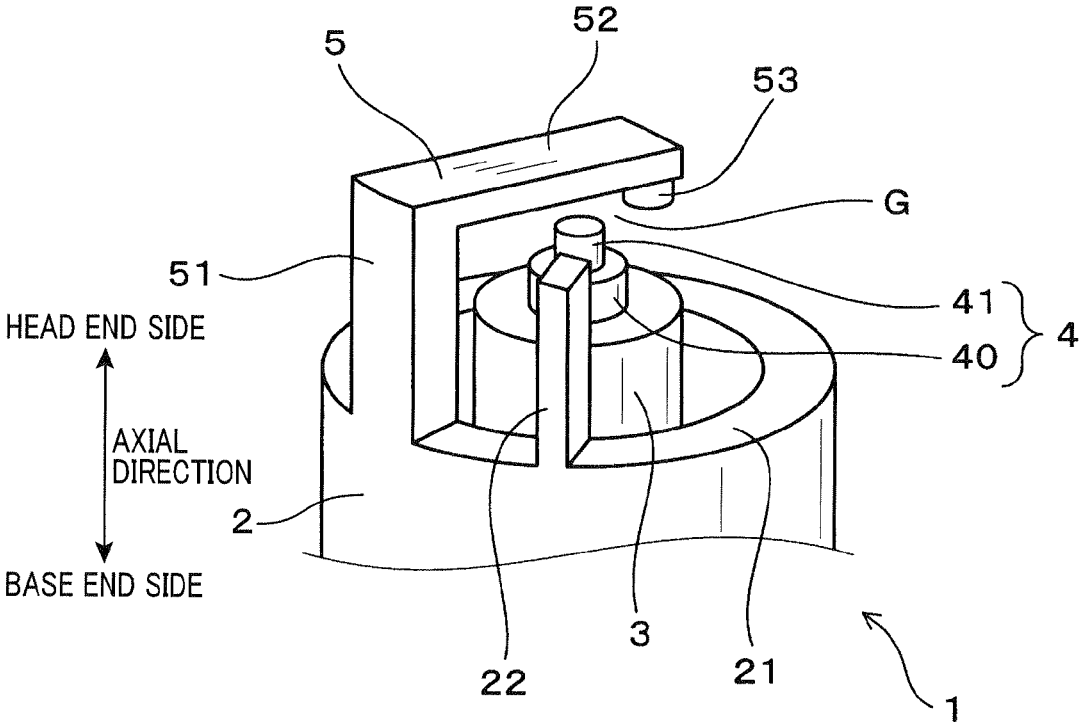
FIG. 1 is a perspective view illustrating the head end of a spark plug, according to a first embodiment of the present invention.
Figure 2:
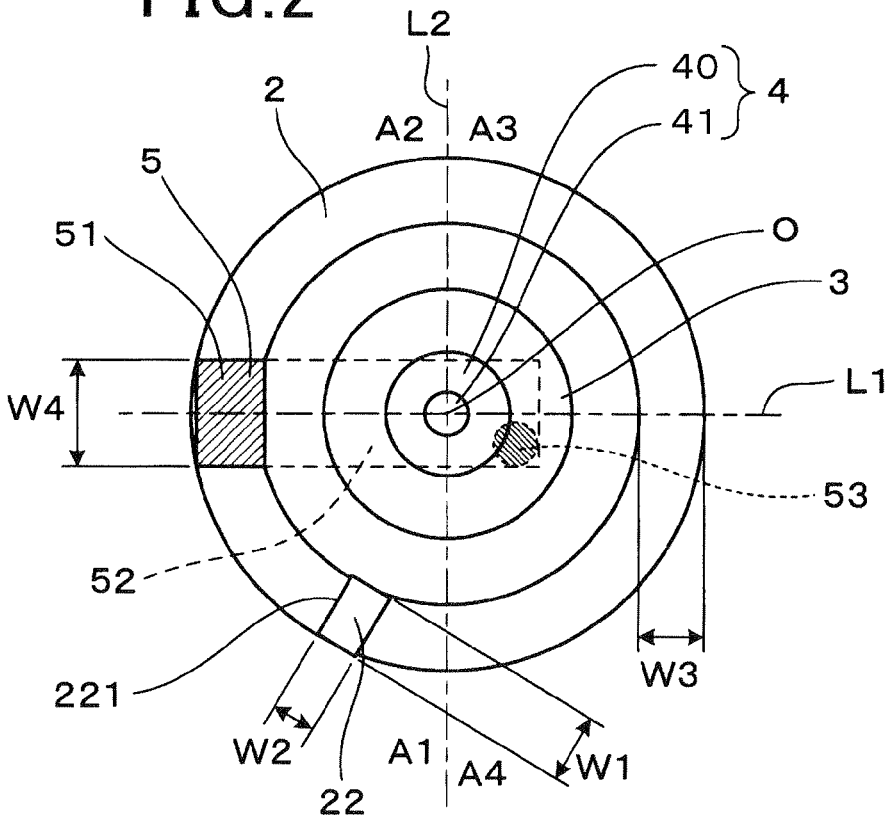
FIG. 2 is a plan view illustrating the spark plug as viewed from the top of the head end in the axial direction of the spark plug.

As shown in FIGS. 1 and 2, the spark plug 1 includes a housing 2, an insulator 3, a center electrode 4 and a ground electrode 5. The housing 2 has a cylindrical shape. The insulator 3 also has a cylindrical shape, held inside the housing 2 and made of such as porcelain. The center electrode 4 is held inside the insulator 3 with an end portion thereof being projected from the insulator 3. The ground electrode 5 is connected to the housing 2, while forming a spark discharge gap G between itself and the center electrode 4. The housing 2 has an end portion 21 from which an end projection 22 is projected toward the head end side of the spark plug 1.

The ground electrode 5 includes an extension portion 51, a facing portion 52 and a ground projection 53. The extension portion 51 extends from the end portion 21 of the housing 2 toward the head end side. The facing portion 52 extends from the extension portion 51 radially inward so as to face the center electrode 4 in the axial direction. The ground projection 53 is projected from a surface of the facing portion 52, the surface being on the side of the center electrode 4.

In FIG. 2, as viewed in the axial direction, a line connecting the circumferential center of the extension portion 51 of the ground electrode 5 to a plug center axis O is designated as a line L1. Also, a line perpendicular to the line L1 at the plug center axis O is designated as a line L2. As shown in FIG. 2, four areas A1, A2, A3 and A4 are defined by the lines L1 and L2. Of these areas, the areas A1 and A2 are also referred to as electrode areas and the areas A3 and A4 are also referred to as open areas.

The extension portion 51 is arranged between the electrode areas A1 and A2. At least a part of the end projection 22 is arranged in one of the two electrode areas A1 and A2 (A1 in the present embodiment). In the present embodiment, the end projection 22 is arranged in its entirety in the electrode area A1.

The center axis of the ground projection 53 is arranged at a position being offset from the plug center axis O. Specifically, the center axis of the ground projection 53 may be arranged in either of the two open areas A3 and A4, other than the electrode areas A1 and A2, among the areas A1 to A4. Alternatively, the center axis of the ground projection 53 may be arranged in the electrode area A1 in which the end projection 22 is at least partially formed. As shown in this embodiment, it is preferable that the whole end face of the ground projection 53 is arranged within the open areas and the electrode area A1 in which the end projection 22 is at least partially formed. In the present embodiment, the ground projection 53 is arranged in the open area A4 adjacent to the electrode area A1 in which the end projection 22 is formed.

In the present embodiment, in the spark plug 1, the housing 2, the insulator 3 and the center electrode 4 are coaxially arranged, each having a shape of a rotating body centering on a common axis. The center electrode 4 includes an end portion 41 and a base 40. The end portion 41 is made up of a noble metal chip having a circular pillar shape, which is adjoined to an end of the base 40. The end portion 41 (noble metal chip) is also coaxially arranged with the housing 2 and the like. In other words, the center axes of the housing 2, the insulator 3 and the center electrode 4 including the end portion 41 all pass through (or include) the plug center axis O.

As shown in FIG. 2, the ground projection 53 is arranged so that an end face thereof will not overlap an end face of the end portion 41 of the center electrode, as viewed in the axial direction. The ground projection 53 is also made up of a noble metal chip having a circular pillar shape, which is adjoined to the facing portion 52 of the ground electrode 5. The end face of the ground projection 53 corresponds to a "discharge portion of the ground electrode" in the claims, and the end face of the end portion 41 corresponds to a "discharge portion of the center electrode" in the claims.

As shown in FIG. 2, the end projection 22 has a radial length designated as W1, while the end portion 21 of the housing 2 has a radial length (thickness) designated as W3. The radial length W1 is rendered to be equal to or smaller than the radial length W3. In the present embodiment, the radial length W1 is substantially the same as the radial length W3. Also, the end projection 22 has a circumferential length designated as W2, while the ground electrode has a circumferential length designated as W4. The circumferential length W2 is rendered to be smaller than the radial length W1. Further, the circumferential length W2 is rendered to be smaller than the circumferential length W4.

Figure 3:
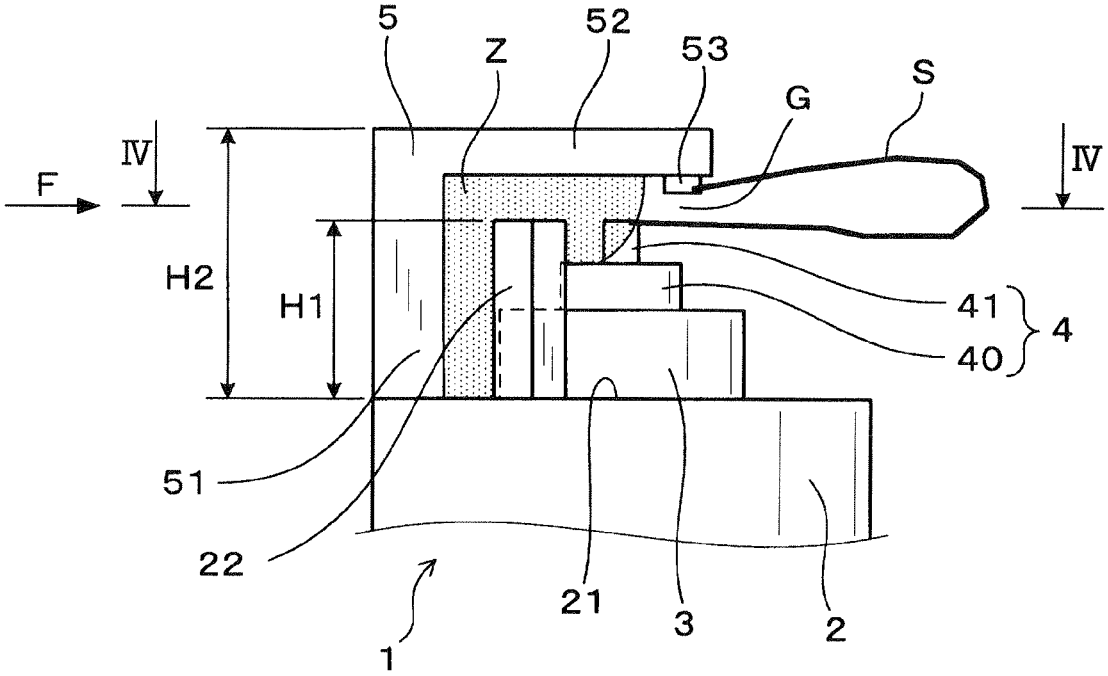
FIG. 3 is a side view illustrating the head end of the spark plug in a state where an uprising portion of a ground electrode is located upstream within a flow of air-fuel mixture.

As shown in FIG. 3, the end projection 22 is projected in the axial direction by a projection amount H1, while the ground electrode 5 is projected in the axial direction by a projection amount H2. The projection amount H1 is rendered to be smaller than the projection amount H2.

The end projection 22 has a substantially square pillar shape and is permitted to uprise from the end portion 21 in parallel with the axial direction. The end projection 22 has a side face 221 (e.g., see FIG. 2) facing the ground electrode 5. The end projection 22 is arranged such that a plane that includes the side face 221 passes through the plug center axis O or passes through the vicinity of the plug center axis O.

Hereinafter are described the advantages and effects of the present embodiment.

Figure 4:
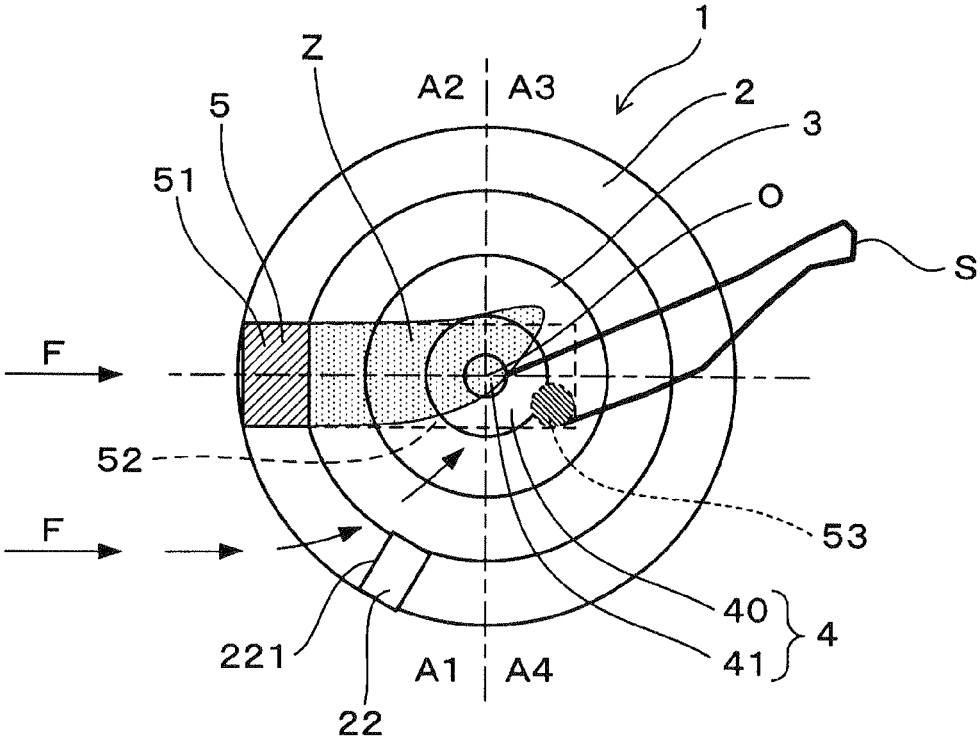
FIG. 4 is a cross-sectional view taken along a line IV-IV of FIG. 3.

The spark plug 1 has the end projection 22 projected toward the head end side from the end portion 21 of the housing 2. Thus, in whatever posture the spark plug 1 may be mounted to the internal combustion engine, a flow of air-fuel mixture in the combustion chamber will not be prevented from being led into the spark discharge gap G. Specifically, for example, as shown in FIGS. 3 and 4, the extension portion 51 of the ground electrode 5 may be located upstream within a flow F of air-fuel mixture with respect to the plug center axis O. In this case, the end projection 22 is able to guide the flow F that has passed beside the extension portion 51 toward the vicinity of the plug center axis O. Specifically, the end projection 22 serves as a guide of the flow F to ensure the flow F to be directed toward the plug center axis O. Thus, the flow F in the vicinity of the spark discharge gap G is prevented from stagnating.

However, when the extension portion 51 of the ground electrode 5 is located upstream within the flow F as shown in FIGS. 3 and 4, the flow F is liable to stagnate in a given space downstream of and in the vicinity of the extension portion 51 to cause a stagnation Z. It is true that the end projection 22 is able to guide the flow F toward the plug center axis O, but that does not mean that the stagnation Z of the flow F is eliminated. In this case, as shown in FIGS. 3 and 4, the stagnation Z of the flow F is likely to be formed at a location which is near the extension portion 51 of the ground electrode 5 and facing the end projection 22 (i.e. on the other side of the end projection 22) across the extension portion 51. More specifically, the stagnation Z is formed centering on the electrode area A2 on the other side of the electrode area A1 in which the end projection 22 is provided, among the four areas A1 to A4. Thus, the stagnation Z is most unlikely to be caused in the open area A4, in particular, which is diagonally opposite to the electrode area A2.

Thus, as shown in FIG. 2, in the spark plug 1, the ground projection 53 of the ground electrode 5 is arranged in the open area and being offset from the plug center axis O. With this arrangement, the spark discharge gap G is brought to a location where the stagnation Z of the flow F is unlikely to be caused. As a result, ignitability is sufficiently ensured under the conditions where the extension portion 51 of the ground electrode 5 is located upstream within the flow F in the combustion chamber. In other words, the stagnation Z is hardly caused in the spark discharge gap G under the conditions where the extension portion 51 is located upstream within the flow F. Accordingly, a discharge spark S generated in the spark discharge gap G is well drawn by the flow F and easily ignited.

In this way, stable ignitability is ensured irrespective of the mounted posture of the spark plug 1 with respect to the internal combustion engine.

The radial length W1 of the end projection 22 is made equal to or smaller than the radial length (thickness) W3 of the end portion 21 of the housing 2. Thus, the end projection 22 is prevented from being extended beyond the inner peripheral edge of the housing 2 and located near the center electrode 4. As a result, no sparks will fly between the end projection 22 and the center electrode 4 to thereby ensure stable ignitability.

In the present embodiment, in particular, with the length W1 being made substantially equal to the thickness W3, the end projection 22 allows its side face 221 to exert a high function of guiding the flow F, while preventing flying sparks (or charging) between the center electrode 4 and it.

Further, the circumferential length W2 of the end projection 22 is made smaller than the circumferential length W4 of the ground electrode 5. Thus, the end projection 22 is unlikely to block the flow F and thus the flow F is effectively prevented from stagnating near the spark discharge gap G.

Furthermore, the circumferential length W2 of the end projection 22 is made smaller than the radial length W1. Thus, the flow F that moves from the upstream toward the vicinity of the head end of the spark plug 1 is efficiently and easily guided by the end projection 22 into the spark discharge gap G. In addition, the adverse effect of the end projection 22 upstream of the spark discharge gap G blocking the flow F is reduced greatly.

Further, the center axis of the end portion 41 of the center electrode 4 passes through the plug center axis O. On the other hand, as viewed in the axial direction, the ground projection 53 is arranged so that an end face thereof will not overlap an end face of the end portion 41 of the center electrode 4. With this configuration, the end portion 41 of the center electrode 4 is not required to be offset from the plug center axis O, which facilitates manufacture of the spark plug 1. From the viewpoint of the structure of the spark plug 1, offsetting the ground projection 53 of the ground electrode 5 from the plug center axis O more easily simplifies the configuration and more easily facilitates manufacture, than offsetting the end portion 41 of the center electrode 4 from the plug center axis O.

As described above, the present embodiment can provide a spark plug for an internal combustion engine, which is able to ensure stable ignitability, irrespective of the mounted posture of the spark plug with respect to the internal combustion engine.

(Second Embodiment)

Figure 5:
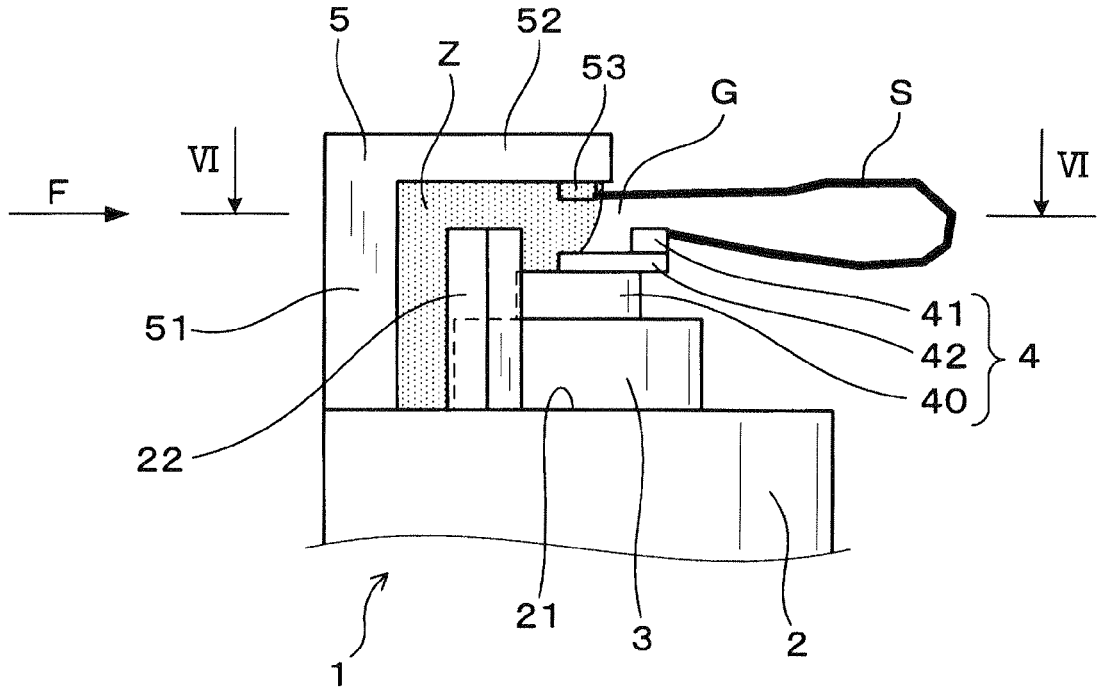
FIG. 5 is a side view illustrating the head end of a spark plug in a state where an extension portion of a ground electrode is located upstream within a flow of air-fuel mixture, according to a second embodiment of the present invention.
Figure 6:
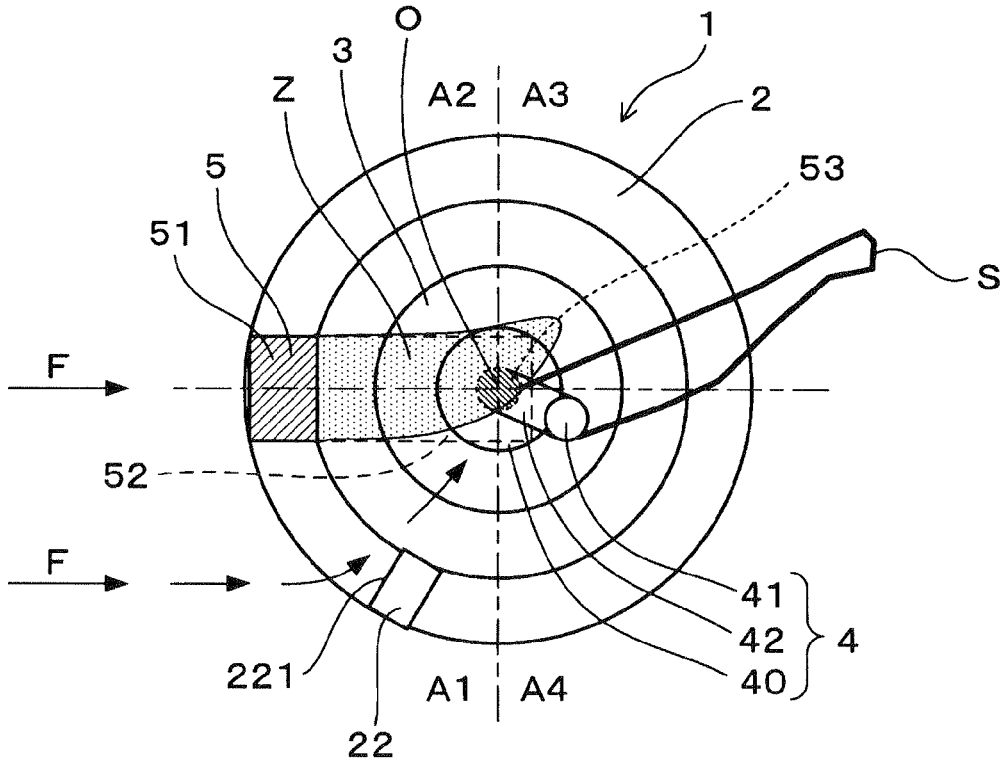
FIG. 6 is a cross-sectional view taken along a line IV-IV of FIG. 5.

Referring now to FIGS. 5 and 6, hereinafter is described a second embodiment of the present invention. It should be appreciated that, in the second and the subsequent embodiments as well as in the comparative examples, the components identical with or similar to those in the first embodiment are given the same reference numerals for the sake of omitting unnecessary explanation.

As shown in FIGS. 5 and 6, in the second embodiment, the ground projection 53 of the ground electrode 5 is arranged so that its center axis passes through the plug center axis O, while the center axis of the end portion 41 of the center electrode 4 is offset from the plug center axis O. As shown in this embodiment, it is preferable that the whole end face of the end portion 41 of the center electrode 4 is arranged within the open areas and the electrode area in which the end projection 22 is arranged.

The end portion 41 of the center electrode 4 is arranged in the open area A4 among the four areas.

In order to realize this arrangement, in the present embodiment, a noble metal chip as the end portion 41 is adjoined to the base 40 of the center electrode 4 via an intermediate member 42. The intermediate member 42 is arranged being extended from the base 40 toward the open area A4. The end portion 41 made up of the noble metal chip is adjoined to the extended end of the intermediate member 42 so as to jut in the axial direction toward the head end side.

The configuration other than the above is similar to the first embodiment.

In the present embodiment as well, the spark discharge gap G can be brought to a location where the stagnation Z of the flow F is unlikely to be caused to thereby ensure stable ignitability.

In addition to the above, the advantages and effects similar to those of the first embodiment can also be enjoyed in the second embodiment.

(Third Embodiment)

Figure 7:
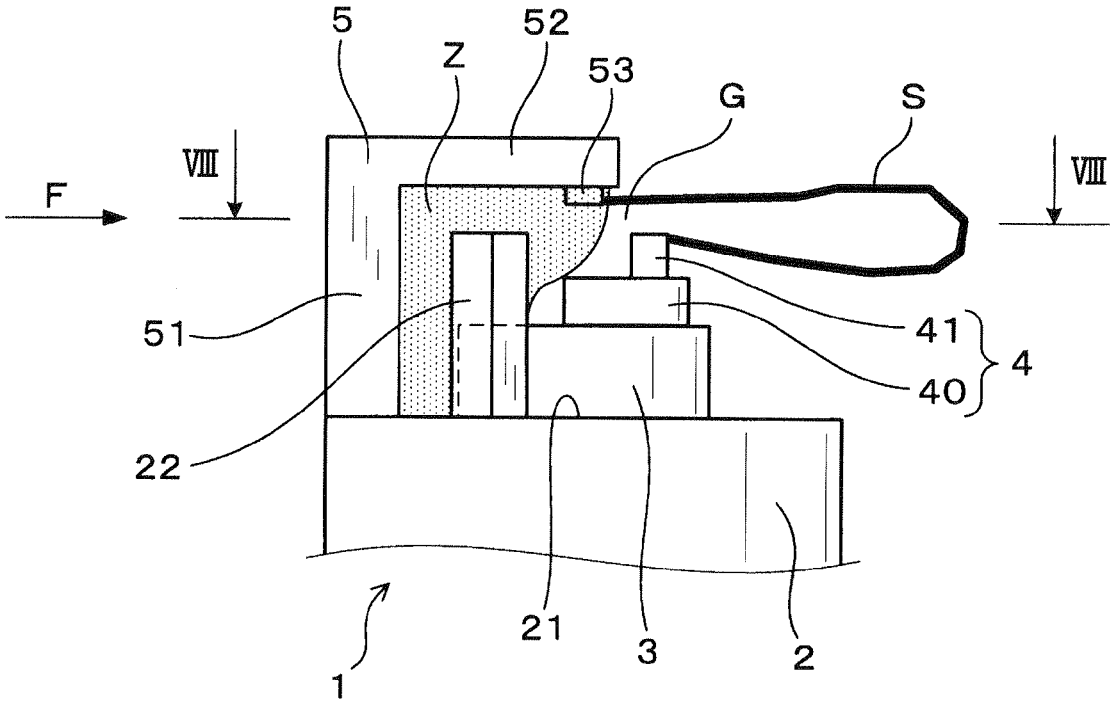
FIG. 7 is a side view illustrating the head end of a spark plug in a state where an extension portion of a ground electrode is located upstream within a flow of air-fuel mixture, according to a third embodiment of the present invention.
Figure 8:
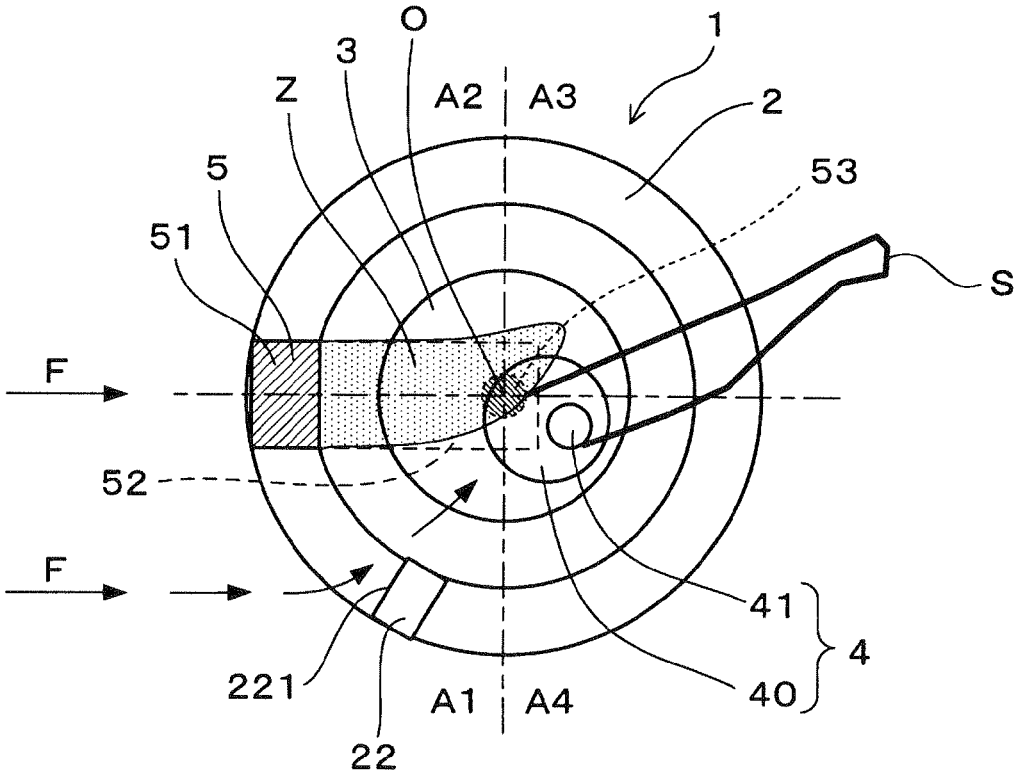
FIG. 8 is a cross-sectional view taken along a line VIII-VIII of FIG. 7.

Referring to FIGS. 7 and 8, a third embodiment of the present invention is described. As shown in FIGS. 7 and 8, in the third embodiment, the center axis of the end portion 41 of the center electrode 4 is offset from the plug center axis O by offsetting the center axis of the end portion 41 of the center electrode 4 from the center axis of the insulator 3.

The housing 2 and the insulator 3 are coaxial with each other, with their center axes passing through the plug center axis O. However, the base 40 of the center electrode 4, which is held inside the insulator 3, is arranged being shifted toward the open area A4 among the four areas. Further, the position of the end portion 41 with respect to the baser 40 of the center electrode 4 is shifted toward the open area A4.

The configuration other than the above is similar to the second embodiment.

The present embodiment is different from the second embodiment in that no intermediate member 42 is required to be provided between the base 40 and the end portion 41. Accordingly, the number of adjoining processes, such as welding, is reduced in the present embodiment compared to the second embodiment.

In addition to the above, the advantages and effects similar to those of the second embodiment can also be enjoyed in the third embodiment.

(Fourth Embodiment)

Figure 9:
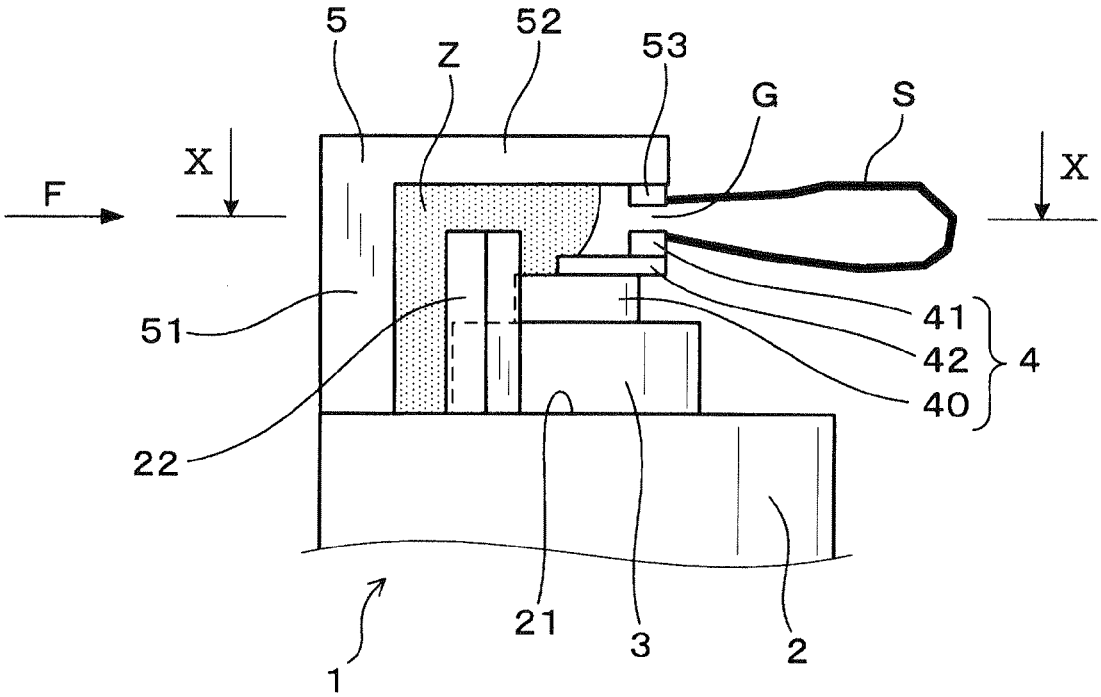
FIG. 9 is a side view illustrating the head end of a spark plug in a state where an extension portion of a ground electrode is located upstream within a flow of air-fuel mixture, according to a fourth embodiment of the present invention.
Figure 10:
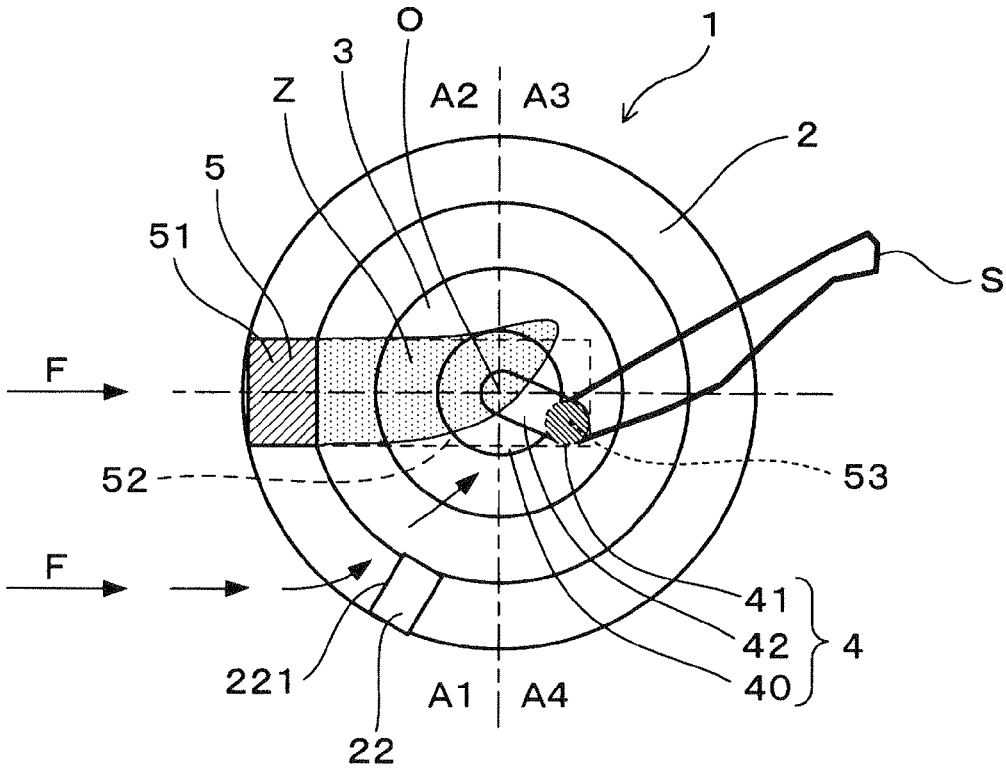
FIG. 10 is a cross-sectional view taken along a line X-X of FIG. 9.

Referring to FIGS. 9 and 10, a fourth embodiment of the present invention is described. As shown in FIGS. 9 and 10, in the fourth embodiment, the center axes of the ground projection 53 and the end portion 41 of the center electrode 4 are both offset from the plug center axis O.

The ground projection 53 and the end portion 41 of the center electrode 4 are both arranged in the open area A4. Further, the ground projection 53 is permitted to face the end portion 41 of the center electrode 4 so that an end face of the ground projection 53 overlap an end face of the end portion 41 in the axial direction. Similar to the second embodiment, the intermediate member 42 is interposed between the base 40 and the end portion 41 of the center electrode 4.

The configuration other than the above is similar to the first embodiment.

The present embodiment is also able to ensure stable ignitability, irrespective of the mounted posture of the spark plug 1 with respect to the internal combustion engine.

In addition to the above, the advantages and effects similar to those of the first embodiment can also be enjoyed in the fourth embodiment.

(Fifth Embodiment)

Figure 11:
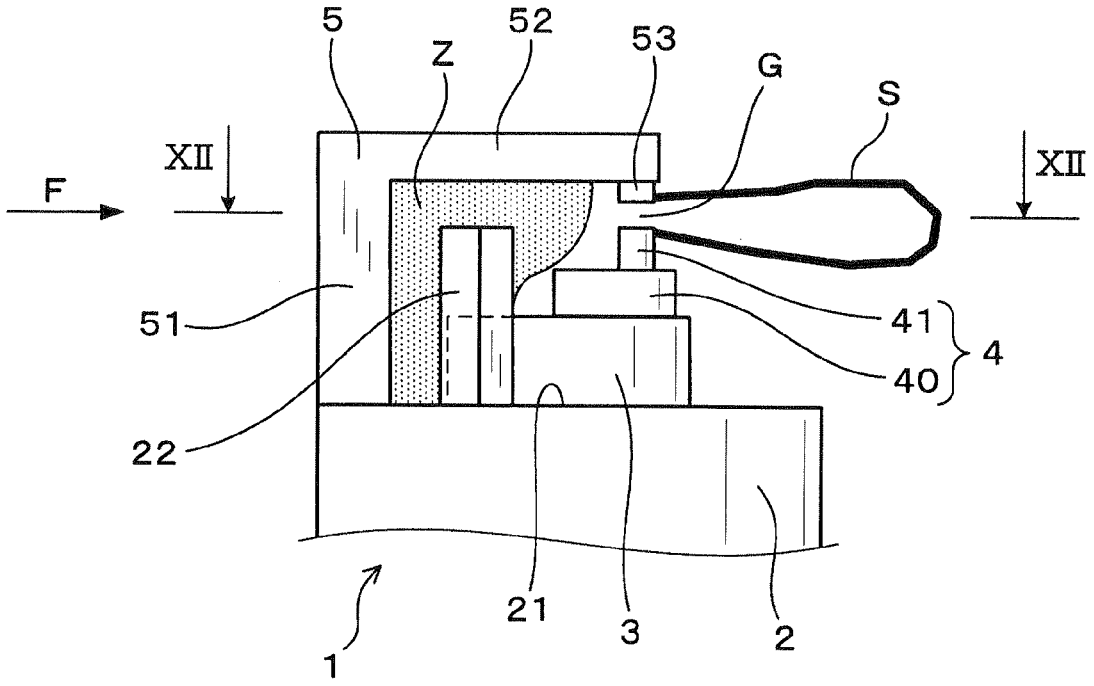
FIG. 11 is a side view illustrating the head end of a spark plug in a state where an extension portion of a ground electrode is located upstream within a flow of air-fuel mixture, according to a fifth embodiment of the present invention.
Figure 12:
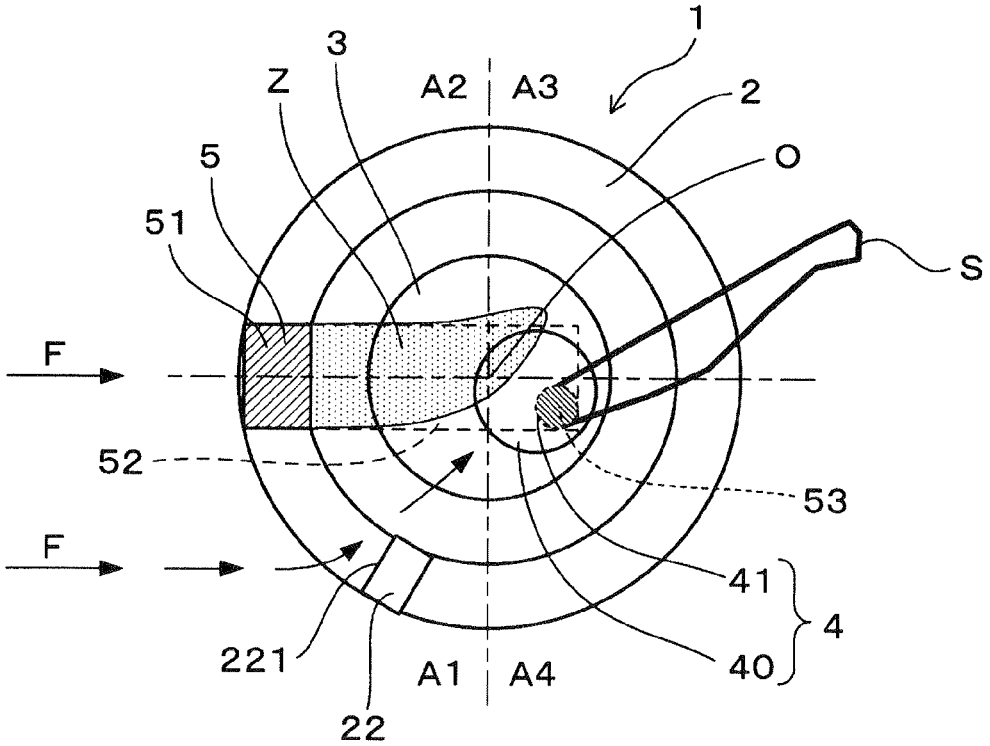
FIG. 12 is a cross-sectional view taken along a line XII-XII of FIG. 11.

Referring to FIGS. 11 and 12, a fifth embodiment of the present invention is described. As shown in FIGS. 11 and 12, in the fifth embodiment as well, the center axes of the ground projection 53 and the end portion 41 of the center electrode 4 are both offset from the plug center axis O, similar to the fourth embodiment.

However, the end portion 41 of the center electrode 4 is offset in a manner similar to the third embodiment. Specifically, the base 40 of the center electrode 4 is shifted toward the open area A4 with respect to the insulator 3. Also, the end portion 41 is shifted toward the open area A4 with respect to the base 40.

Thus, the ground projection 53 and the end portion 41 of the center electrode 4 are both arranged in the open area A4.

The configuration other than the above is similar to the fourth embodiment.

In the present embodiment, the advantages and effects of both of the third and fourth embodiments can be enjoyed.

In addition to the above, the advantages and effects similar to those of the first embodiment can also be enjoyed in the fifth embodiment.

(Sixth Embodiment)

Figure 13:
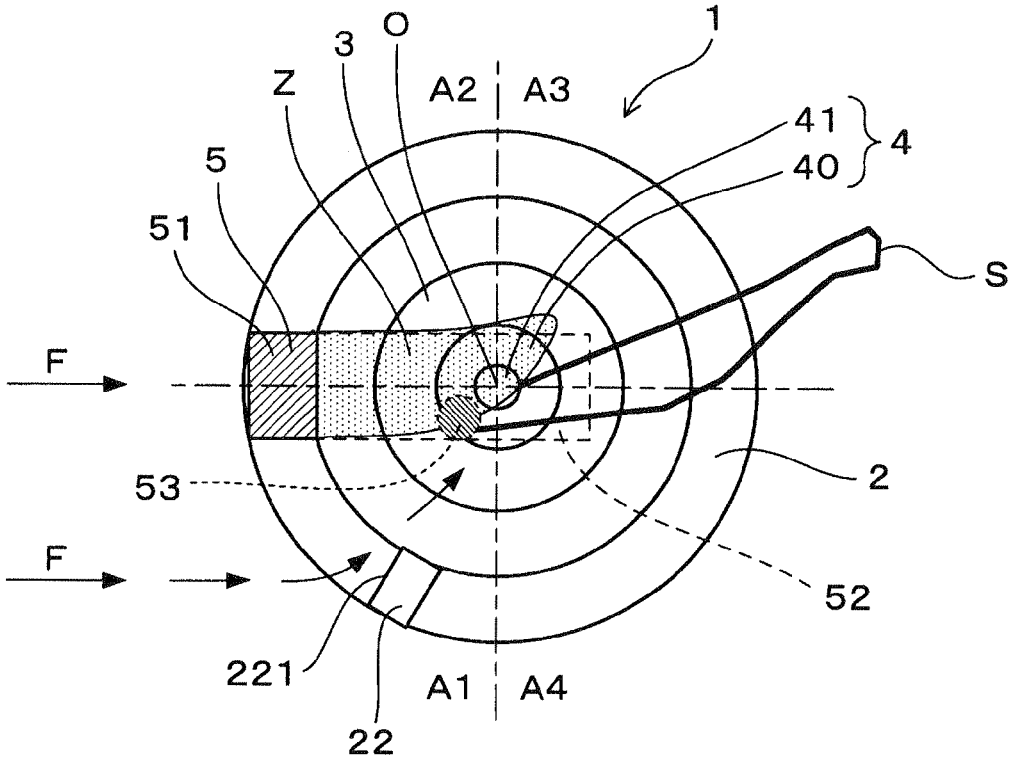
FIG. 13 is a plan view illustrating the head end of a spark plug in a state where an extension portion of a ground electrode is located upstream within a flow of air-fuel mixture, according to a sixth embodiment of the present invention.

Referring to FIG. 13, a sixth embodiment of the present invention is described. As shown in FIG. 13, in the sixth embodiment, the ground projection 53 is arranged in the electrode area A1 among the four areas.

In other words, in the spark plug 1 according to the present embodiment, the ground projection 53 is arranged in the electrode area A1 where the end projection 22 is also arranged.

The configuration other than the above is similar to the first embodiment.

In the present embodiment as well, the spark discharge gap G can be arranged in an area, i.e. the electrode area A1, which is different from the electrode area A2 where the stagnation Z of the flow F is likely to be formed. Accordingly, stable ignitability is ensured, irrespective of the mounted posture of the spark plug 1 with respect to the internal combustion engine.

In addition to the above, the advantages and effects similar to those of the first embodiment can also be enjoyed in the sixth embodiment.

(Seventh Embodiment)

Figure 14:
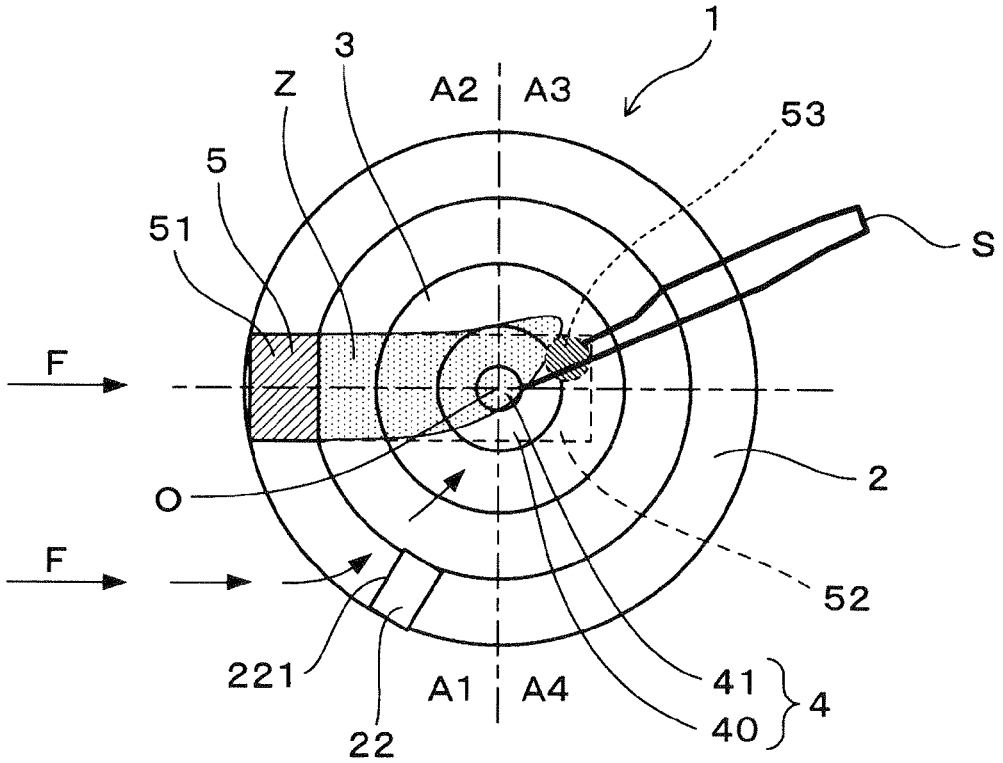
FIG. 14 is a plan view illustrating the head end of a spark plug in a state where an extension portion of a ground electrode is located upstream within a flow of air-fuel mixture, according to a seventh embodiment of the present invention.

Referring to FIG. 14, a seventh embodiment of the present invention is described. As shown in FIG. 14, in the seventh embodiment, the ground projection 53 is arranged in the open area A3 among the four areas.

Specifically, in the spark plug 1 of the present embodiment, the ground projection 53 is arranged in the open area A3 which is diagonally opposite to the electrode area A1 where the end projection 22 is provided.

The configuration other than the above is similar to the first embodiment.

In the present embodiment as well, the spark discharge gap G can be arranged in an area, i.e. the open area A3, which is different from the electrode area A2 where the stagnation Z of the flow F is likely to be formed. Accordingly, stable ignitability is ensured, irrespective of the mounted posture of the spark plug 1 with respect to the internal combustion engine.

In addition to the above, the advantages and effects similar to those of the first embodiment can also be enjoyed in the sixth embodiment.

(Comparative Example 1)

Figure 15:
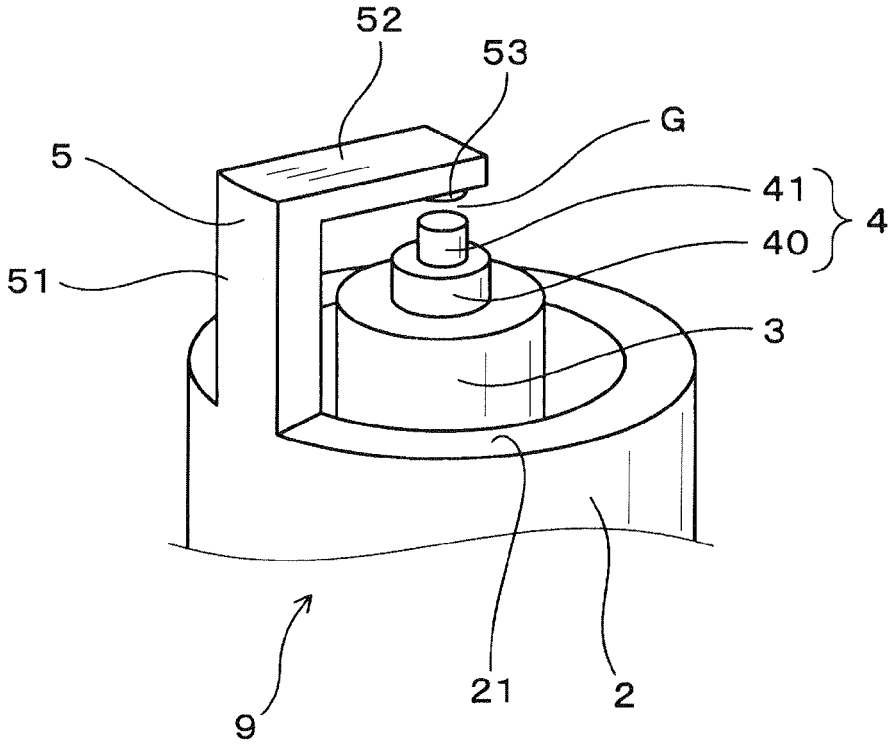
FIG. 15 is a perspective view illustrating the head end of a spark plug according to a comparative example 1.
Figure 16:
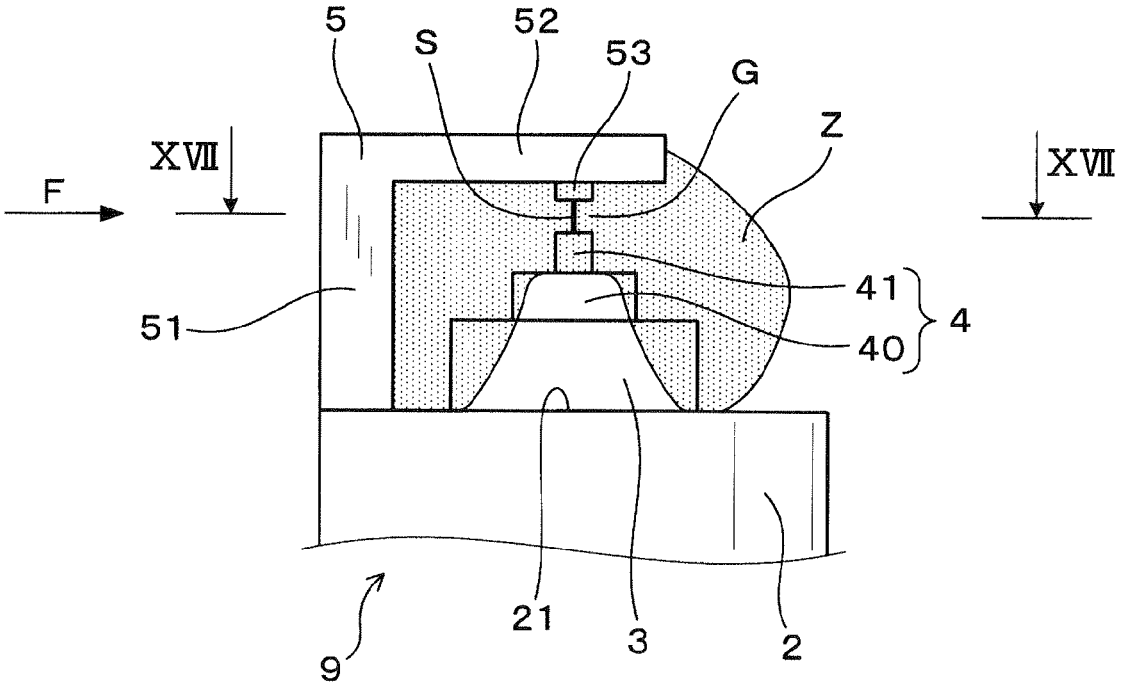
FIG. 16 is a side view illustrating the head end of the spark plug in a state where an extension portion of a ground electrode is located upstream within a flow of air-fuel mixture, according to the comparative example 1.
Figure 17:
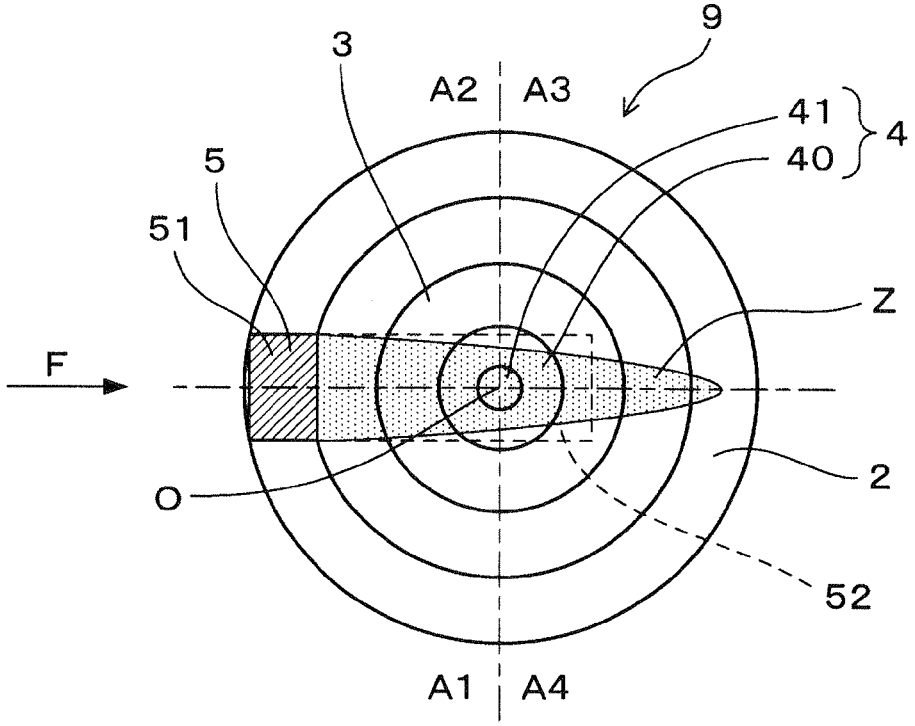
FIG. 17 is a cross-sectional view taken along a line XVII-XVIII of FIG. 16.

Referring to FIGS. 15 to 17, a comparative example 1 is described. FIGS. 15 to 17 show a spark plug 9 according to the comparative example 1. As shown in FIGS. 15 to 17, in the comparative example 1, the end portion 41 of the center electrode 4 is permitted to face the ground projection 53 of the ground electrode 5, with the center axes of the both passing through the plug center axis O. Also, the spark plug 9 of the comparative example 1 is not provided with the end projection 22 that has been provided in the first to seventh embodiments.

The configuration other than the above is similar to the first embodiment.

As shown in FIGS. 16 and 17, in a mounted posture of the spark plug 9, the extension portion 51 of the ground electrode 5 may be located upstream of the flow F with respect to the plug center axis O. With this location, the stagnation Z of the flow F is formed covering the spark discharge gap G. As a result, the discharge spark S is hardly drawn by the flow F and thus ignitability is easily deteriorated.

On the other hand, in a mounted posture of the spark plug 9, the extension portion 51 of the ground electrode 5 is not necessarily located upstream of the flow F. For example, the location of the extension portion 51 with respect to the plug center axis O may be on a line perpendicular to the direction of the flow F. With this location, no stagnation Z will be formed in the spark discharge gap G, and thus the discharge spark S will be well drawn by the flow F to thereby enhance ignitability.

In this way, in the spark plug 9 of the comparative example 1, ignitability is varied to a large extent depending on the mounted posture of the spark plug 9 with respect to the internal combustion engine. Accordingly, it is difficult to ensure stable ignitability.

(Comparative Example 2)

Figure 18:
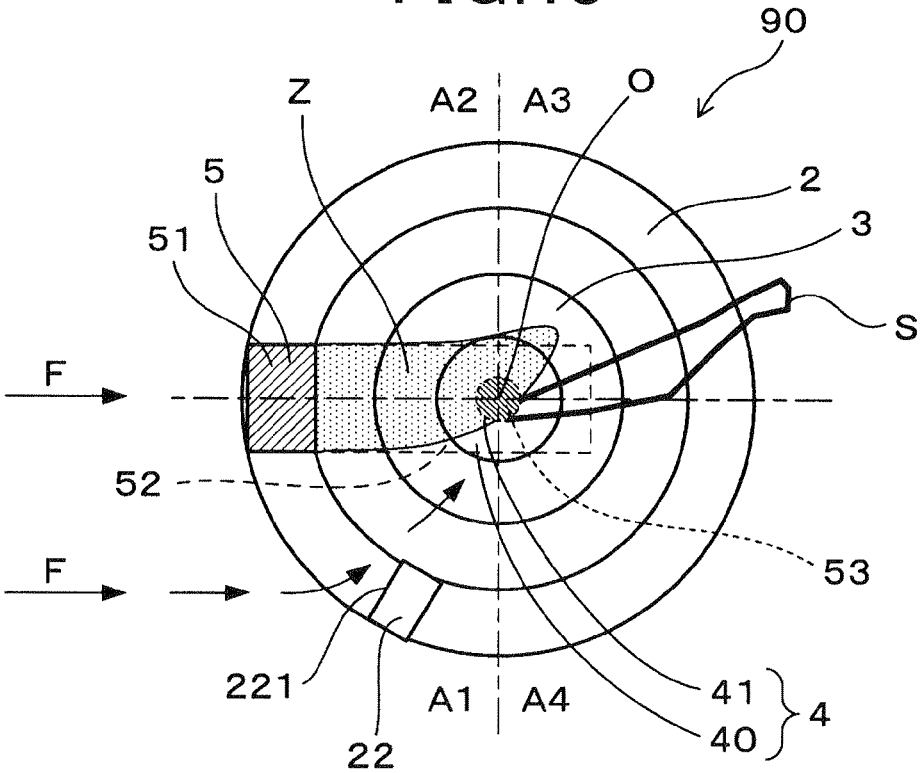
FIG. 18 a plan view illustrating the head end of a spark plug in a state where an extension portion of a ground electrode is located upstream within a flow of air-fuel mixture, according to a comparative example 2.

Referring to FIG. 18, a comparative example 2 is described. FIG. 18 shows a spark plug 90 according to the comparative example 2. As shown in FIG. 18, the spark plug 90 is provided with the end projection 22. Also, the end portion 41 of the center electrode 4 is permitted to face the ground projection 53 of the ground electrode 5, with the center axes of the both passing through the plug center axis O.

Specifically, the spark plug 90 of the comparative example 2 is provided with the end projection 22, similar to the first embodiment. However, the center axis of neither of the end portion 41 and the ground projection 53 is offset from the plug center axis O, but the end portion 41 and the ground projection 53 are arranged being opposed to each other, with the center axes of the both passing through the plug center axis O.

The configuration other than the above is similar to the first embodiment.

In the comparative example 2, when the extension portion 51 of the ground electrode 5 is located upstream of the flow F with respect to the plug center axis O, the end projection 22 can exert the guiding function to thereby direct the flow F to the vicinity of the plug center axis O. Accordingly, the discharge spark S is drawn by the flow F to some extent and thus ignitability is expected to be enhanced compared to the comparative example 1.

However, in this mounted posture, the stagnation Z of the flow F is formed partially covering the spark discharge gap G. Accordingly, the length of the discharge spark S drawn by the flow F will be smaller than in the comparative example 1. Thus, it is considered that there is a limit in the enhancement of ignitability in the comparative example 2.

(Experimental Examples)

Figure 19:
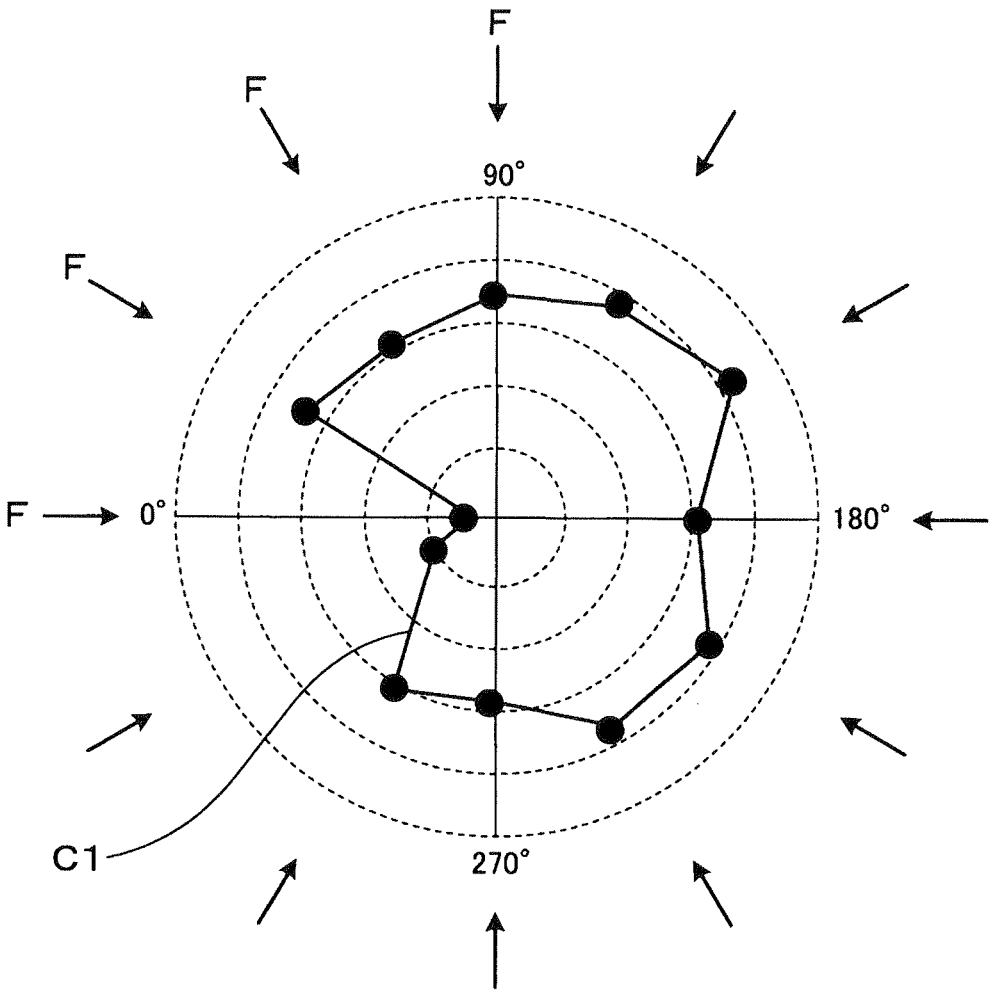
FIG. 19 is a polygonal line graph showing an experimentally obtained relationship between mounted posture with respect to an internal combustion engine and A-F limit, associated with the spark plug of the comparative example 1.
Figure 20:
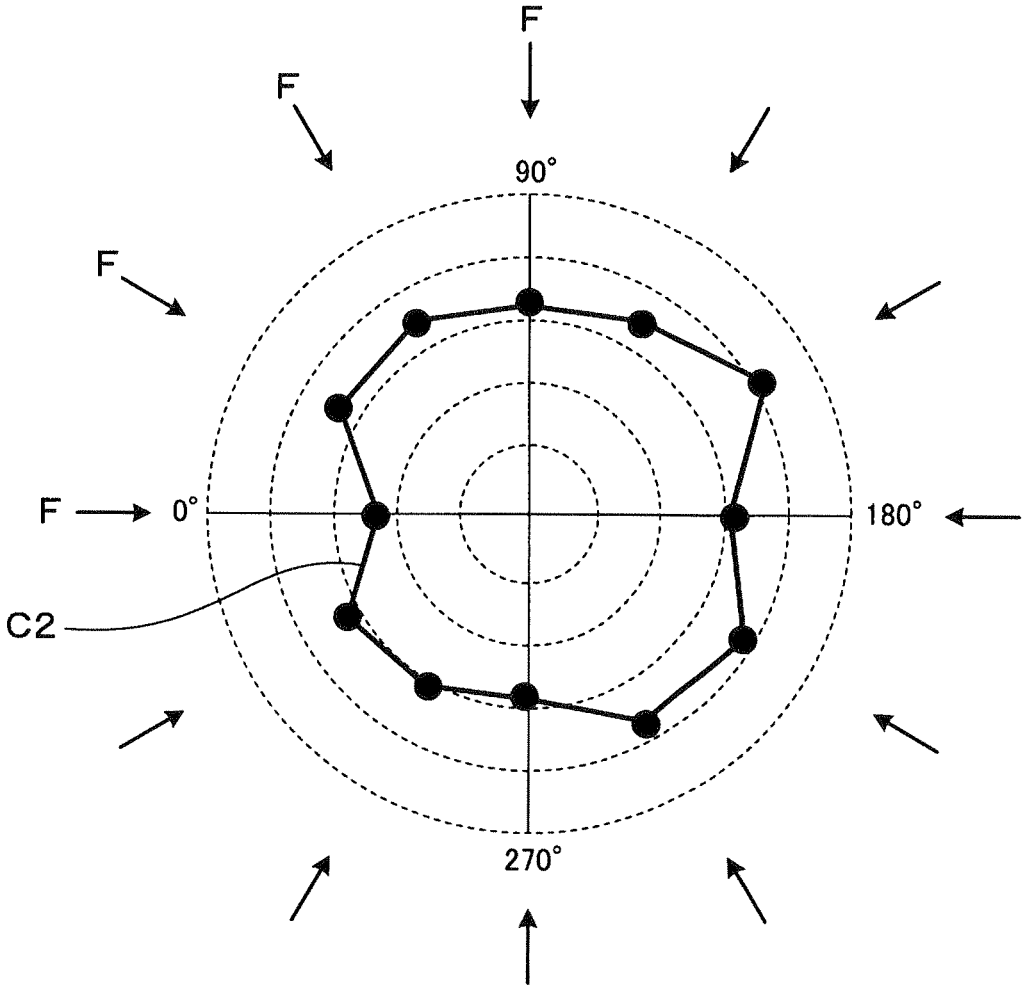
FIG. 20 is a polygonal line graph showing an experimentally obtained relationship between mounted posture with respect to an internal combustion engine and A-F limit, associated with the spark plug of the comparative example 2.
Figure 21:
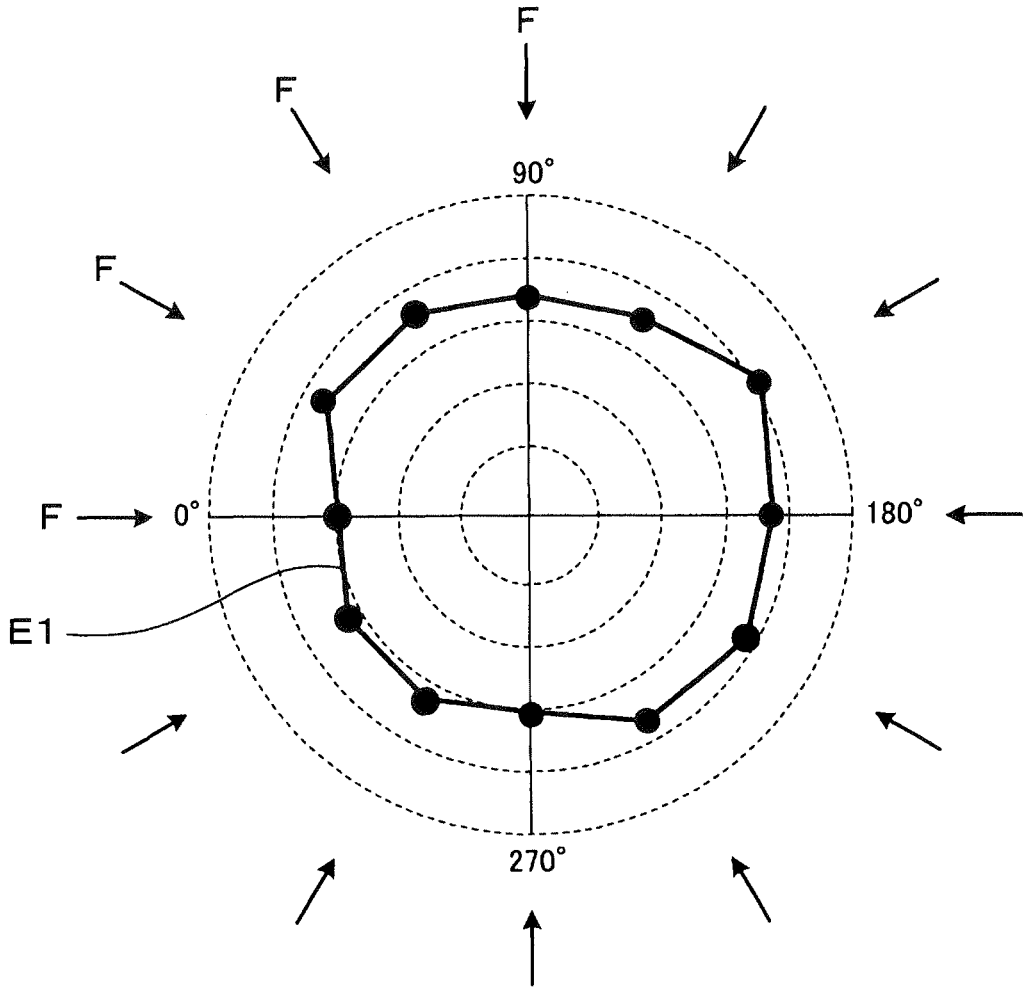
FIG. 21 is a polygonal line graph showing an experimentally obtained relationship between mounted posture with respect to an internal combustion engine and A-F limit, associated with the spark plug of the first embodiment of the present invention.

Referring to FIGS. 19 to 21, experimental examples are described. FIGS. 19 to 21 show the results of experiments conducted using the spark plug 1 of the first embodiment, the spark plug 9 of the comparative example 1 and the spark plug 90 of the comparative example 2. Specifically, FIGS. 19 to 21 show how A-F limit (critical air-fuel ratio) changes depending on the location of the extension portion 51 of the ground electrode 5 with respect to the flow F in the respective spark plugs 1, 9 and 90.

Specifically, in the experiments, the extension portion 51 of the ground electrode 5 was shifted so that an angle β was increased from 0 degree to 330 degrees on a 30-degree basis. The angle β indicates an angle between the direction of the flow F and the line connecting the center of the circumferential length W4 of the extension portion 51 to the plug center axis O when the respective spark plugs are viewed in the axial direction. Every time the angle β was increased by 30 degrees, A-F limit was measured. Specifically, when the angle β is 0 degree, the extension portion 51 of the ground electrode 5 is located upstream with respect to the plug center axis O and when the angle β is 180 degrees, the extension portion 51 of the ground electrode 5 is located downstream with respect to the plug center axis O. The measurements of A-F limit were conducted using the spark plug 1 of the first embodiment, the spark plug 9 of the comparative example 1 and the spark plug 90 of the comparative example 2.

The measurements of A-F limit were conducted by changing the orientation of each of the spark plugs 1, 9 and 90 with respect to the flow F, i.e. by increasing the angle β by 30 degrees, as mentioned above. The speed of the flow F was 14 m/s.

The results of the measurements are shown in the polygonal line graphs of FIGS. 19 to 21. FIG. 19 shows, with a polygonal line graph C1, the results of the measurements conducted of the spark plug 9 of the comparative example 1. FIG. 20 shows, with a polygonal line graph C2, the results of the measurements conducted of the spark plug 90 of the comparative example 2. FIG. 21 shows, with a polygonal line graph E1, the results of the measurements conducted of the spark plug 1 of the first embodiment.

In each of the figures, A-F limit is higher as the polygonal line is positioned more outward from the center (origin) of the concentric circles indicated by the broken lines. Specifically, in each of the figures, the value of A-F limit is 24 at the center (origin) of the concentric circles, and 26 at the outermost circle. The circles drawn at even intervals between the center and the outermost circle are scale mark circles indicating the values of A-F limit as being 24.4, 24.8, 25.2 and 25.6, from inner to outer circles.

In FIG. 19 showing the measurements of A-F limit in the spark plug 9 of the comparative example 1, the polygonal line graph C1 is distorted. This means that A-F limit, or ignitability, of the spark plug 9 varies to a large extent in the upstream portion of the flow F. In other words, A-F limit, or ignitability, of the spark plug 9 greatly depends on the mounted posture of the spark plug 9 with respect to the internal combustion engine. In particular, A-F limit is extremely low when the angle β is 0 degree. Thus, it will be understood from FIG. 19 that A-F limit is extremely low when the extension portion 51 of the ground electrode 5 is located upstream of the flow F with respect to the spark discharge gap G, and that ignitability then is considerably deteriorated.

Thus, ignitability of the spark plug 9 of the comparative example 1 is varied to a large extent depending on the mounted posture of the spark plug 9 with respect to the internal combustion engine.

In FIG. 20 showing the measurements of A-F limit in the spark plug 90 of the comparative example 2, the polygonal line graph C2 is approximately circular centering on the origin. This means that ignitability of the spark plug 90 does not vary to a large extent depending on its mounted posture with respect to the flow F but that stable ignitability is ensured to some extent. However, A-F limit lowers when the angle β is 0 degree in the polygonal line graph C2, i.e. when the extension portion 51 of the ground electrode 5 is located upstream of the flow F. Thus, it will be understood from FIG. 20 that the provision of the end projection 22 can stabilize ignitability but that there is still room for improvement.

In contrast, in FIG. 21 showing the measurements of A-F limit in the spark plug 1 of the first embodiment, the polygonal line graph E1 is more approximated to a circular shape than the polygonal line graph C2 associated with the comparative example 2. In particular, A-F limit is sufficiently large when the angle β is 0 degree, i.e. when the extension portion 51 of the ground electrode 5 is located upstream of the flow F. This means that the spark plug 1 of the first embodiment is able to ensure sufficient ignitability, irrespective of its mounted posture.

As will be understood from the results of the experiments, use of the spark plug 1 of the first embodiment can ensure stable ignitability, irrespective of its mounted posture.

(Modifications)

In the first to seventh embodiments described above, the end projection 22 is arranged in its entirety in the electrode area A1. Alternative to this, for example, the end projection 22 may be arranged straddling the electrode area A1 and the open area A4. In other words, for example, the side face 221 of the end projection 22 may be located in the electrode area A1.

As a matter of course, the advantages and effects similar to those of the above embodiments may be obtained if the positions of the end projection 22, the ground projection 53, the end portion 41 of the center electrode 4 and the like are inverted with reference to the line L1.

In the first to seventh embodiments described above, the end portion 41 of the center electrode 4 and the ground projection 53 are each made up of a noble metal chip. However, these components do not have to be necessarily made up of a noble metal chip. For example, the end portion 41 of the center electrode 4 may be made of the same material as that of the base 40. In other words, the end portion 41 may be formed by extending the base 40. Further, the ground projection 53 may be formed by partially projecting and deforming the facing portion 52 of the ground electrode 5.

Alternatively, the discharge portion of the ground electrode 5 not need to project from the surface of the facing portion 52, the surface of the facing portion 52 can became the discharge portion. In this case, the center of a part of the surface of the facing portion 52, the part directly facing the discharge portion of the center electrode 4 in the axial direction, corresponds to a "center of the discharge portion" in the claims. If there is no part which directly faces the discharge portion of the center electrode 4, the center of a part of the surface of the facing portion 52, spark discharges mainly occurring between the part and the discharge portion of the center electrode 4, corresponds to a "center of the discharge portion" in the claims.

In addition, the shape of the end portion 41 of the center electrode 4 and the ground projection 53 is not particularly limited to a circular pillar shape, but may, for example, be a polygonal pillar shape.

What is claimed is:

1. A spark plug for an internal combustion engine, comprising:

a housing formed to surround a plug center axis, and to have an end portion;

a center electrode arranged inside the housing, extended along the axial direction and formed to have an end where a discharge portion is formed;

a ground electrode connected to the housing; and an end projection projected from the end portion of the housing toward a head end side of the spark plug, wherein, the ground electrode comprises:

an extension portion extended from the end portion of the housing toward the head end side of the spark plug;

a facing portion extended from the extension portion radially inward to face the center electrode in the axial direction;

a discharge portion formed on a center electrode side surface of the facing portion, and configured to form a spark discharge gap between itself and the discharge portion of the center electrode, the center electrode side surface being on the center electrode side of the spark plug, wherein, as viewed in the axial direction of the spark plug, when, a line extending through the circumferential center of the extension portion of the ground electrode and the plug center axis is designated as a first line, a line perpendicular to the first line at the plug center axis is designated as a second line, four areas are defined by the first and second lines, two areas of the four areas, in which the extension portion is arranged, are referred to as electrode areas, and, the other areas are referred to as open areas:

at least a part of the end projection is arranged in one of the two electrode areas; and at least one of the discharge portions of the ground electrode and the center electrode is arranged such that the center of the at least one of the discharge portions is arranged offset from the plug center axis, and, such that the center of the at least one of the discharge portions is arranged in either of the two open areas; and the end projection has a first surface, the first surface being inclined with respect to the first line and being inclined with respect to the second line, such that the first surface is not perpendicular to the first line and the first surface is not perpendicular to the second line, and such that the first surface of end projection is in one of the two electrode areas.

2. The spark plug according to claim 1, wherein, the end projection has a radial length equal to or smaller than a radial length of the end portion of the housing, and the end projection is disposed such that the end projection does not extend beyond the inner peripheral edge of the housing inwardly toward the center electrode.

3. The spark plug according to claim 1, wherein, the end projection has a circumferential length smaller than a circumferential length of the extension portion.

4. The spark plug according to claim 1, wherein, the end projection has a circumferential length smaller than a radial length of the end projection, and the end projection is disposed such that the end projection does not extend beyond the inner peripheral edge of the housing inwardly toward the center electrode.

5. The spark plug according to claim 1, wherein, at least one of the discharge portions is arranged such that its center is arranged in the open area adjacent to the electrode area in which at least a part of the end projection is arranged.

6. The spark plug according to claim 1, wherein:

the center of the discharge portion of the center electrode is arranged on the plug center axis; and the discharge portion of the ground electrode is arranged not to overlap the discharge portion of the center electrode, as viewed in the axial direction of the spark plug.

7. The spark plug according to claim 1, wherein, both the discharge portions are arranged within the open area and the electrode area in which at least a part of the end projection is arranged, as viewed in the axial direction of the spark plug.

8. The spark plug according to claim 1, wherein the end projection is disposed such that the end projection does not extend beyond the inner peripheral edge of the housing inwardly toward the center electrode.

9. The spark plug according to claim 1, wherein the first surface of the end projection is configured to guide air flow to the spark discharge gap between the center electrode and the ground electrode.

* * * * *